United States Patent [19]

Lipp

[11] Patent Number: 4,705,535

[45] Date of Patent: Nov. 10, 1987

[54] NOZZLE FOR ACHIEVING CONSTANT MIXING ENERGY

[75] Inventor: Charles W. Lipp, Baton Rouge, La.

[73] Assignee: The Dow Chemical Company, Midland, Mich.

[21] Appl. No.: 839,252

[22] Filed: Mar. 13, 1986

[51] Int. Cl.[4] ..... C10J 3/68

[52] U.S. Cl. ..... 48/77; 48/86 R; 48/DIG. 7; 48/DIG. 10; 239/61; 261/62; 261/DIG. 38

[58] Field of Search ..... 48/77, 86 R, DIG. 7, 48/DIG. 10; 55/21; 159/44; 261/62, DIG. 38; 431/75, 90; 239/61

[56] References Cited

U.S. PATENT DOCUMENTS

| | | | |
|---|---|---|---|
| 2,391,422 | 12/1945 | Jackson | 299/140 |
| 2,531,479 | 11/1950 | Southern et al. | 261/DIG. 38 |
| 2,550,390 | 4/1951 | Stephanoff | 241/1 |
| 3,696,997 | 10/1972 | Gifford | 261/DIG. 38 |
| 4,502,633 | 3/1985 | Saxon | 48/DIG. 7 |
| 4,525,175 | 6/1985 | Stellaccio | 48/DIG. 7 |
| 4,547,150 | 10/1985 | Vereecke | 431/75 |

FOREIGN PATENT DOCUMENTS

| | | | |
|---|---|---|---|
| 2457139 | 1/1976 | Fed. Rep. of Germany | 431/90 |
| 1405093 | 9/1975 | United Kingdom | 431/90 |

*Primary Examiner*—David L. Lacey

*Attorney, Agent, or Firm*—E. E. Spielman; D. R. Howard

[57] ABSTRACT

This invention relates to a two-fluid nozzle which is adjustable to provide a substantially constant mixing energy. Adjustment of the two-fluid nozzle is made in accordance with the pressure and mass flow values of the liquid and gas fed to the nozzle. A microprocessor calculates the mixing energy from these values and provides an output to the nozzle to adjust it should its mixing energy be in variance with a pre-selected mixing energy.

14 Claims, 2 Drawing Figures

NOZZLE FOR ACHIEVING CONSTANT MIXING ENERGY

BACKGROUND OF THE INVENTION

Figure 1:
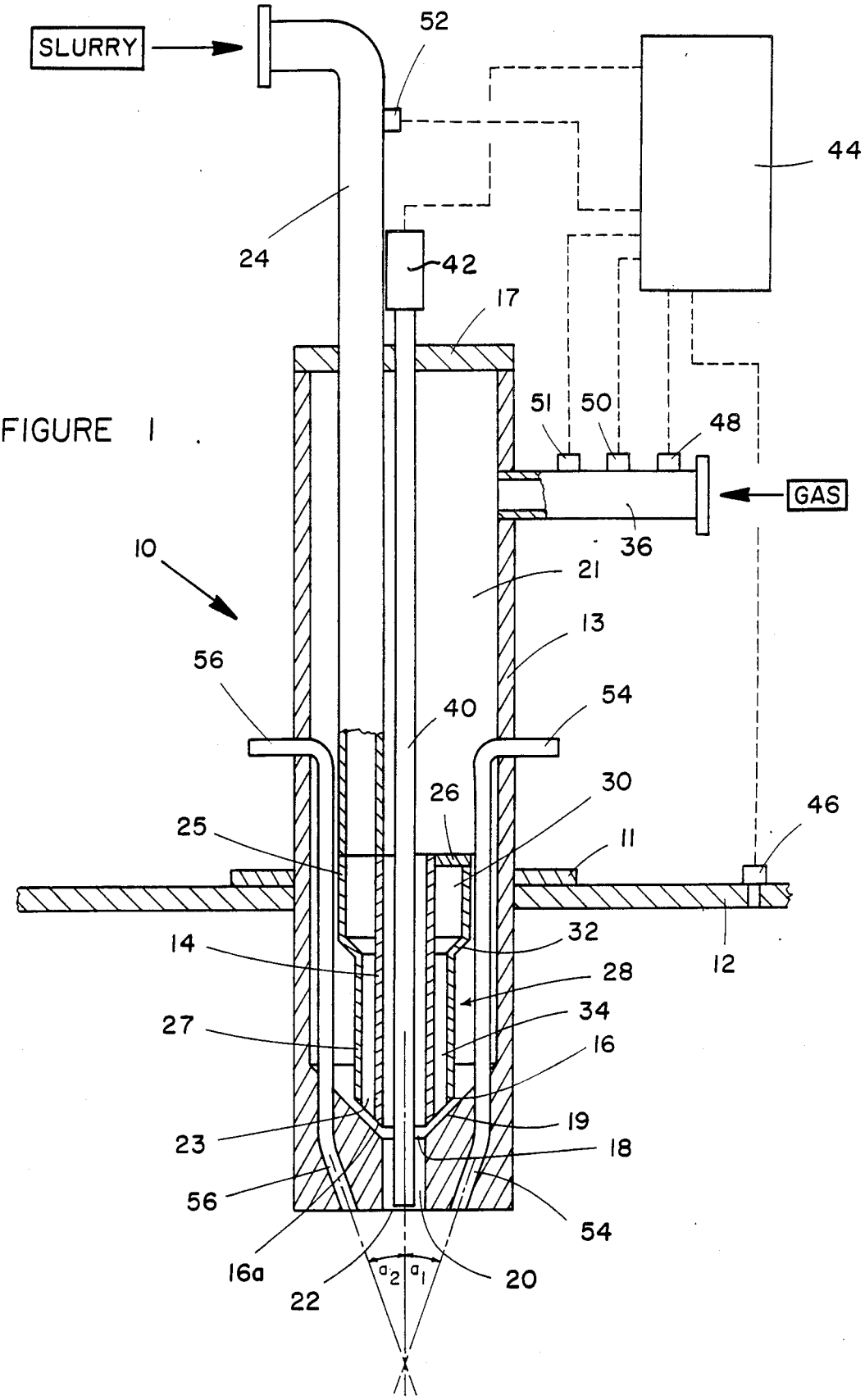

This invention concerns a two-fluid nozzle which is adjustable to provide a substantially constant mixing energy. This invention also concerns an improved process for the partial oxidation of a carbonaceous slurry to produce a $H_2$ and CO containing product gas.

Two-fluid nozzles, also called gas-atomizing nozzles or pneumatic nozzles, break up a stream of liquid by contacting it with a high velocity stream of gas, usually air or steam. The degree of break-up, i.e., atomization, of the liquid has been found to be directly related to the mixing energy provided by the nozzle. Mixing energy is defined as either the isothermic or adiabatic gas expansion energy per unit mass of liquid being atomized and is partially dependent upon the pressure drop across the nozzle. In application, the nozzle is dimensioned and configured to provide the required pressure drop to achieve the desired mixing energy, given the gas identity, mass flow rate and temperature of the gas and the mass flow rate of the liquid. So long as the above variables affecting mixing energy remain constant, the nozzle will produce the atomization required. This constancy in atomization is very important in spray drying as liquid particle size must be specified and uniform to produce the desired product. Constant uniform atomization is also very important when the atomizer is acting to feed a reaction vessel, such as a coal gasifier. Coal gasification by non-catalytic partial oxidation of a carbonaceous slurry needs uniform atomization to insure proper burn, to prevent hot spots in the reaction zone and to achieve process efficiency.

It is recognized that maintenance of atomizer dimension and configuration is especially difficult when the liquid to be atomized contains solids, such as would be the case in coal gasification where the liquid is a slurry comprised, for example, of water and ground coal. These solids can erode the nozzle to such an extent that its pressure drop design is lost. With a change in pressure drop, there is a concomitant change in mixing energy thereby altering the degree of atomization. Re-establishing the desired atomization criteria generally entails shutting down the process and replacing the nozzle. This can be very expensive, especially if the reaction zone must be depressurized and cooled down to achieve nozzle replacement.

It is therefore an object of this invention to provide a two-fluid nozzle and process therefor which yields uniform atomization through maintaining substantially constant mixing energy during continuance of the served process, e.g., spray drying, partial oxidation, and the like.

THE INVENTION

This invention relates to an apparatus for the discharge of an atomized liquid-gas dispersion. The apparatus features a two-fluid nozzle which is adjustable to provide a substantially constant mixing energy for effecting the atomization of the liquid. The liquid and the gas are communicated to the two-fluid nozzle by separate conduits leading from their respective sources. The gas can be nitrogen, air, steam and the like, the only requirement being that the gas be suitable for achievement of the atomization required and that the gas not adversely affect the process served by the apparatus or any of the equipment associated therewith.

Determination of the mixing energy provided by the two-fluid nozzle is preferably determined by the following derived adiabatic gas expansion equation:

$$E_M = \frac{CM_g}{M_L}\left(\frac{K}{K-1}\right)\left[\left(\frac{P_g}{P_v}\right)^{\frac{K-1}{K}} - 1\right]\frac{RT}{Ag}$$

For this equation: C is 0.07250; $M_g$ is mass flow of gas, measured as lbs/hr; $M_L$ is mass flow of liquid, measured as lbs/hr: R is the gas law constant and is 10.73; T is the downstream gas temperature, measured as $^oR$; $_{Ag}$ is the atomic weight of the gas; K is the heat capacity ratio of the gas components; $P_g$ is the gas pressure at the point of feed to the two-fluid nozzle, measured as psia; and $P_v$ is the vessel gas pressure, measured as psia.

An alternative method, though not preferred, includes calculating mixing energy with the isothermal gas expansion formula:

$$E_M = \frac{(0.0733)\,(M_g)\,(R)\,(T)\,[\ln(P_g/P_v)]}{M_L}$$

The units for $M_g$, $M_L$, R, T, $P_g$ and $P_v$ are the same as for the adiabatic gas expansion equation just described.

Since it is a feature of the apparatus of this invention that the two-fluid nozzle is adjustable during the ongoing operation of the served process, it is necessary that the mixing energy be monitored and measured either periodically or continuously. To achieve such monitoring and measuring of mixing energy, the value of the variables most likely to change in the above equation, i.e., $M_g$, $M_L$, $P_g$ and $P_v$, must be determined. (If there is an expected change in gas temperature, then the gas temperature must also be determined, however, in most cases, this value will be constant.)

To achieve the mass flow and pressure monitoring, the apparatus of this invention provides for a first and second pressure sensing means which determines, respectively, the gas pressure in the vessel and the gas pressure adjacent the point of feed to the two-fluid nozzle. To measure the mass of liquid and gas communicated to the two-fluid nozzle, there is provided, for each, a flow sensing device.

The pressure sensing devices and the flow sensing devices are most conveniently of the type which can input electrical signals to a microprocessor which is programmed: to receive the outputs of the sensing devices; to calculate the mixing energy based upon the sensed values; to compare the calculated mixing energy value against a pre-selected energy value; and to provide an output to achieve adjustment, if needed, of the two-fluid nozzle to maintain a constant mixing energy. Other calculating and comparing means besides a microprocessor may be used to calculate the mixing energy. For example, the mixing energy can be calculated by hand, using the measured values and a calculator.

As mentioned previously, two-fluid nozzles atomize the stream of liquid by contacting it with a high velocity stream of gas. In a first embodiment, the apparatus of this invention features a two-fluid nozzle which provides for such contacting by having the gas and liquid pass through a cylindrical chamber having a coaxial, axially movable restrictor rod therein. The resultant annular space has a cross-sectional area for flow less than the sum of the cross-sectional areas for flow of the gas and liquid passages to it. The cylindrical chamber and restrictor rod are dimensioned to provide a sufficient pressure drop, i.e., $P_G$-$P_v$, across the chamber so that the gas is accelerated to a sufficient velocity to break up the liquid to achieve the desired degre of atomization. The liquid will also experience an increase in its velocity, however, its velocity will be less than the gas velocity thereby allowing the gas to shear the liquid and yield the necessary liquid break-up. The pressure drop, and thus the gas velocity, can be altered through the cylindrical chamber by axially moving the restrictor rod to adjust its position within the cylindrical chamber. As the restrictor rod is located closer to the discharge end of the cylindrical chamber, $P_G$ will increase and thus the pressure drop will also increase and the gas will obtain a greater velocity. Retraction of the restrictor rod to a location further from the discharge end of the cylindrical chamber will decrease $P_G$ and the resultant pressure drop and, thus, the gas velocity. Since gas velocity is directly related to the gas expansion energy numerator in the definition of mixing energy, its adjustment, i.e., increase or decrease, can be used to maintain constant mixing energy.

In the most common cases, changes in mixing energy can be affected by a change in the mass of gas or liquid delivered to the nozzle or by a change in the vessel pressure. If the mass of the gas is lowered, the gas velocity, and thus the pressure drop across the cylindrical chamber, must be increased to yield a gas expansion energy value to keep the mixing energy constant. On the other hand, an increase in the mass of the gas will require a reduction in gas velocity and pressure drop for obtainment of the desired gas expansion energy value. Should there be a change in the liquid mass fed to the nozzle, there will be a resultant change in the denominator of the mixing energy equation. This will require a change in the gas expansion energy numerator to yield a substantially constant mixing energy value. The nozzle adjustment needed for these changes in gas or liquid masses is achieved, for this first embodiment of this invention, by the axial movement of the restrictor rod to a position further from the discharge end of the cylindrical chamber than the original position if the gas or liquid mass is decreased and to a position closer to the discharge end than the original position if they are increased. Movement of the restrictor rod, once again, will change the gas velocity in response to the change in the pressure drop value caused by the change in $P_G$. If there should be a change in the vessel pressure then the gas velocity is changed in an inverse manner.

In another case, mixing energy can fall due to a decrease in gas velocity because of nozzle erosion. More specifically, for the just described embodiment, erosion may enlarge the diameter of the cylindrical chamber to reduce the pressure drop and thus gas velocity. To bring the pressure drop back to a value to restore the gas velocity required to maintain mixing energy constancy, the restrictor rod is moved to a position closer to the discharge end of the cylindrical chamber to increase $P_G$ which will increase the pressure drop to the needed value.

It is to be understood that in some cases, the gas and liquid masses, the gas pressures and the vessel pressures may all change. In these cases, also, the restrictor rod is moved to give the gas pressure necessary and thus the pressure drop required to achieve the gas velocity needed to yield substantially a constant mixing energy.

Restrictor rod movement in accordance with obtainment of the required $P_G$ is automatically accomplished by use of the before-described monitoring and measuring devices and microprocessor, the latter providing an output to an actuator, such as an electric motor, to move the restrictor rod towards or away from the discharge end of the cylindrical chamber.

A second embodiment of this invention is an apparatus which utilizes, in a similar way, the just-described relationships between $P_G$, pressure drop, gas velocity and mixing energy. The apparatus features a two fluid nozzle which provides a frusto-conical gas passageway which has a cross-sectional flow area less than the cross-sectional flow area of the gas conduit supplying gas thereto. A pressure drop is experienced by the gas as it passes through the frusto-conical passageway. The nozzle also provides a central conduit through which the liquid passes, which conduit is axially circumscribed at its discharge end by the frusto-conical gas passageway so that the gas emitting therefrom impacts the discharging liquid in a conical pattern. This impacting results in liquid shear and thus liquid atomization. Th greater the velocity of the gas for a given gas mass, the greater the gas expansion energy available per unit mass of liquid, and thus, the greater the mixing energy value. To provide for a change in the pressure drop and thus gas velocity, this second embodiment provides two frusto-conical surfaces, one stationary and one movable, to change the cross-sectional area for flow of the frusto-conical gas passageway. In a preferred form, an annular restrictor slidably mounted on the liquid conduit is provided. At the end of the restrictor, which is proximate to the stationary frusto-conical surface, is the other frusto-conical surface. The stationary surface is provided by the gas conduit having a frusto-conical surface at its discharge end. The base of the stationary frusto-conical surface faces the apex of the movable frusto-conical surface and has its apex forming the discharge end of the gas conduit. The two surfaces ar coaxially located so that movement of the movable surface towards the discharge end brings it into the interior of the space defined by the stationary surface. This movement towards the discharge end reduces the cross-sectional area for flow of the frusto-conical gas passageway to cause an increase in the pressure drop realized by the gas passing therethrough. Movement to a location further away from the discharge end causes an increase in the cross-sectional flow area and thus a decrease in the pressure drop. The relationship between the $P_G$, pressure drop and gas velocity is the same as that discussed above for the first described embodiment and may be utilized in the same manner for the second embodiment to maintain constancy in mixing energy.

The principles underlying the nozzles of this invention are useful in designing a process burner and process which is especially suitable for the manufacture of synthesis gas, fuel gas, or reducing gas by the partial oxidation of a carbonaceous slurry. Such partial oxidation can occur in a vessel which provides a reaction zone normally maintained at a pressure in the range of from about 15 to about 3500 psig (about 1.05 kg/cm$^2$ gauge to about 246 kg/cm$^2$ gauge) and at a temperature within the range of from about 1700° F. (927° C.) to about 3500° F. (1927° C.). A typical partial oxidation gas generating vessel is described in U.S. Pat. No. 2,809,104. The process burner is affixed to the vessel whereby the carbonaceous slurry, an oxygen-containing gas and, optionally, a gaseous temperature moderator are fed through the burner's two-fluid nozzle into the reaction zone. For the sake of simplicity, the gas stream, whether it contains the temperature moderator or not, will be referred to as the oxygen-containing gas stream. The process burner, due to its hereinafter described configuration, is capable of not only providing a substantially constant degree of atomization of the carbonaceous slurry over a long period of process time, but is also capable of providing uniform dispersion of the atomized slurry particles in the oxygen-containing gas. By being able to provide such constancy in the degree of atomization and uniformity of dispersion, improved and long term uniform combustion is achieved in the reaction zone.

Prior art process burners which are not capable of adjusting the degree of atomization or achieve uniformity of dispersion can experience uneven burning, hot spots, and the production of unwanted by-products such as carbon, $CO_2$, etc. Also, such process burners will have to be replaced periodically due to erosion thereby requiring costly process shutdown. Even further, such prior art process burners are not capable of maintaining the desired atomization and dispersion during turn down operations without great difficulty.

Also, an important feature of the subject process burner is that the uniform dispersion and atomization occur inside the burner which allows for more exact control of the carbonaceous slurry droplet size before it is combusted in the reaction zone. The prior art nozzles which attempt to effect most, if not all, of the atomization within the reaction zone have less control over droplet size as further atomization is forced to occur in an area, i.e., the reaction zone, which is, by atomization standards, unconfined. Also, if the atomization process occurs in the reaction zone it has to compete, time-wise, with the combustion of the carbonaceous slurry and the oxygen-containing gas.

The process burner structurally provides a center cylindrical oxygen-containing gas stream, an annular carbonaceous slurry stream and a frusto-conical oxygen-containing gas stream. These streams are concentric with and radially displaced from another in the order that they are named above so that the center gas stream is within the annular carbonaceous slurry stream and so that the annular carbonaceous slurry stream will intersect the frusto-conical oxygen-containing gas stream at an angle within the range of from about 15° to about 75°. The velocities of the oxygen-containing gas streams are within the range of from about 75 ft/sec 22.86 meters/sec.) to about sonic velocity and are greater than the slurry stream which has a minimum velocity of about 1 ft/sec. (0.3048 m/sec.). Substantially uniform dispersion of the carbonaceous slurry in the oxygen-containing gas is achieved by the arrangement of the streams and their velocity disparity. The frusto-conical and the center cylindrical oxygen-containing gas streams both provide shearing of the annular slurry stream to effect the dispersion and some initial atomization of the slurry stream.

The fact that the annular slurry can have a relatively thin wall thickness contributes to the ability of the gas streams to effect the good dispersion and initial atomization realized. Subsequent to the dispersion and initial atomization, the dispersion of slurry and gas is passed through a cylindrical conduit having a coaxial, axially movable restrictor rod therein. The conduit-restrictor rod combination is located adjacent the apex of the frusto-conical stream. The cylindrical conduit and restrictor rod provide a cross-sectional area for flow which is less than the combined cross-sectional areas of the annular carbonaceous slurry stream and the center cylindrical and frusto-conical oxygen-containing gas streams. The restrictor rod coacts with the cylindrical conduit in the same manner and for the same reasons already hereinbefore described for the first embodiment of this invention. Also, the process burner, like the first embodiment, has necessary sensing means for inputting a microprocessor programmed with either of the before mentioned equations for mixing energy, all as before described for the first embodiment. The microprocessor has an output which drives an actuator means to move the restrictor rod within the cylindrical conduit to give the pressure drop necessary to keep the mixing energy substantially constant. The changes in $P_g$, $P_v$, $M_g$, $M_L$, and T which can occur and the adjustment in $P_g$ to maintain constant mixing energy described for the first embodiment ar equally applicable to the subject process burner.

The process burner can be either temporarily or permanently mounted to the vessel's burner port. Permanent mounting can be used when there is additionally permanently mounted to the vessel a pre-heat burner. In this case, the pre-heat burner is turned on to achieve the initial reaction zone temperature and then turned off. After the pre-heat burner is turned off, the process burner of this invention is then operated. Temporary mounting of the process burner is used in those cases where the pre-heat burner is removed after the initial heating and replaced by the process burner.

The produced synthesis, fuel or reducing gas contains, for the most part, hydrogen and carbon monoxide and may contain one or more of the following: $CO_2$, $H_2O$, $N_2$, Ar, $CH_4$, $H_2S$, and COS. The raw gas product stream may also contain, depending upon the fuel available and the operating conditions used, entrained matter such as particulate carbon soot, fly ash or slag. Slag which is produced by the partial oxidation proces and which is not entrained in the produced gas stream will be directed to the bottom of the vessel and continuously removed therefrom.

The term "carbonaceous slurries" as used herein refers to slurries of solid carbonaceous fuels which are pumpable and which generally have a solids content within the range of from about 40 to about 80% and which are passable through the hereinafter described conduits of the process burner embodiment of this invention. These slurries are generally comprised of a liquid carrier and the solid carbonaceous fuel. The liquid carrier may be either water, liquid hydrocarbonaceous materials, or mixtures thereof. Water is the preferred carrier. Liquid hydrocarbonaceous materials which are useful as carriers are exemplified by the following materials; liquified petroleum gas, petroleum distillates and residues, gasoline, naptha, kerosene, crude petroleum, asphalt, gas oil, residual oil, tar, sand oil, shale oil, coal-derived oil, coal tar, cycle gas oil from fluid catalytic cracking operations, fufural extract of coke or gas oil, methanol, ethanol, other alcohols, by-product oxygen-containing liquid hydrocarbons from oxo and oxyl synthesis and mixtures thereof, and aromatic hydrocarbons such as benzene, toluene, xylene, etc. When using a hydrocarbon carrier, it is preferred that water or steam be incorporated in the slurry. Another liquid carrier is liquid carbon dioxide. To ensure that the carbon dioxide is in liquid form, it should be introduced into the process burner at a temperature within the range of from about −67° F. to about 100° F. (about 55° C. to about 38° C.) depending upon the pressure. It is reported to be most advantageous to have the liquid slurry comprise from about 40 to about 70 weight percent solid carbonaceous fuel when liquid $CO_2$ is utilized.

The solid carbonaceous fuels are generally those which are selected from the group consisting of coal, coke from coal, char from coal, coal liquification residues, petroleum coke, particulate carbon soot in solids derived from oil shale, tar sands and pitch. The type of coal utilized is not generally critical as anthracite, bituminous, sub-bituminous and lignite coals are useful. Other solid carbonaceous fuels are for example: bits of garbage, dewatered sanitary sewage, and semi-solid organic materials such as asphalt, rubber and rubber-like materials including rubber automobile tires. As mentioned previously, the carbonaceous slurry used in the process burner of this invention is pumpable and is passable through the process burner conduits designated. To this end, the solid carbonaceous fuel component of the slurry is preferably finely ground so that substantially all of the material passes through an ASTM E 11-70C Sieve Designation Standard 140 mm (Alternative Number 14) and at least 80% passes through an ASTM E 11-70C Sieve Designation Standard 425 mm (Alternative Number 40). The sieve passage being measured with the solid carbonaceous fuel having a moisture content in the range of from about 0 to about 40 weight percent.

The oxygen-containing gas utilized in the process burner of this invention can be either air, oxygen-enriched air, i.e., air that contains greater than 20 mole percent oxygen, and substantially pure oxygen.

As mentioned previously, temperature moderators may be utilized with the subject process burner. These temperature moderators are usually used in admixture with the carbonaceous slurry stream and/or the oxygen-containing gas stream. Exemplary of suitable temperature moderators are steam, $CO_2$, $N_2$, and a recycled portion of the gas produced by the partial oxidation process described herein.

Another feature of the process burner of this invention is that it provides for the introduction of fuel gas to the reaction zone, which introduction is exterior of the process burner. One of the benefits realized by the exterior introduction of the fuel gas is that the fuel gas flame is maintained at a distance from the burner face. If the fuel gas flame is adjacent the burner face, burner damage can occur. When the oxygen-containing gas is high in $O_2$ content, say 50%, then the introduction of fuel gas from the interior of a process burner is most undesirable as the flame propagation of most fuel gases in a high $O_2$ atmosphere is very rapid. Thus, there is always the danger that the flame could propagate up into the burner causing severe damage to the burner. Such fuel gas introduction can be provided by having at least one fuel gas port open onto the face of the burner and directed so that the fuel gas stream will intersect the atomized dispersion leaving the discharge end of the cylindrical chamber.

The fuel gas which is discharged exteriorally of the subject process burner includes such gases as methane, ethane, propane, butane, synthesis gas, hydrogen and natural gas.

Figure 2:
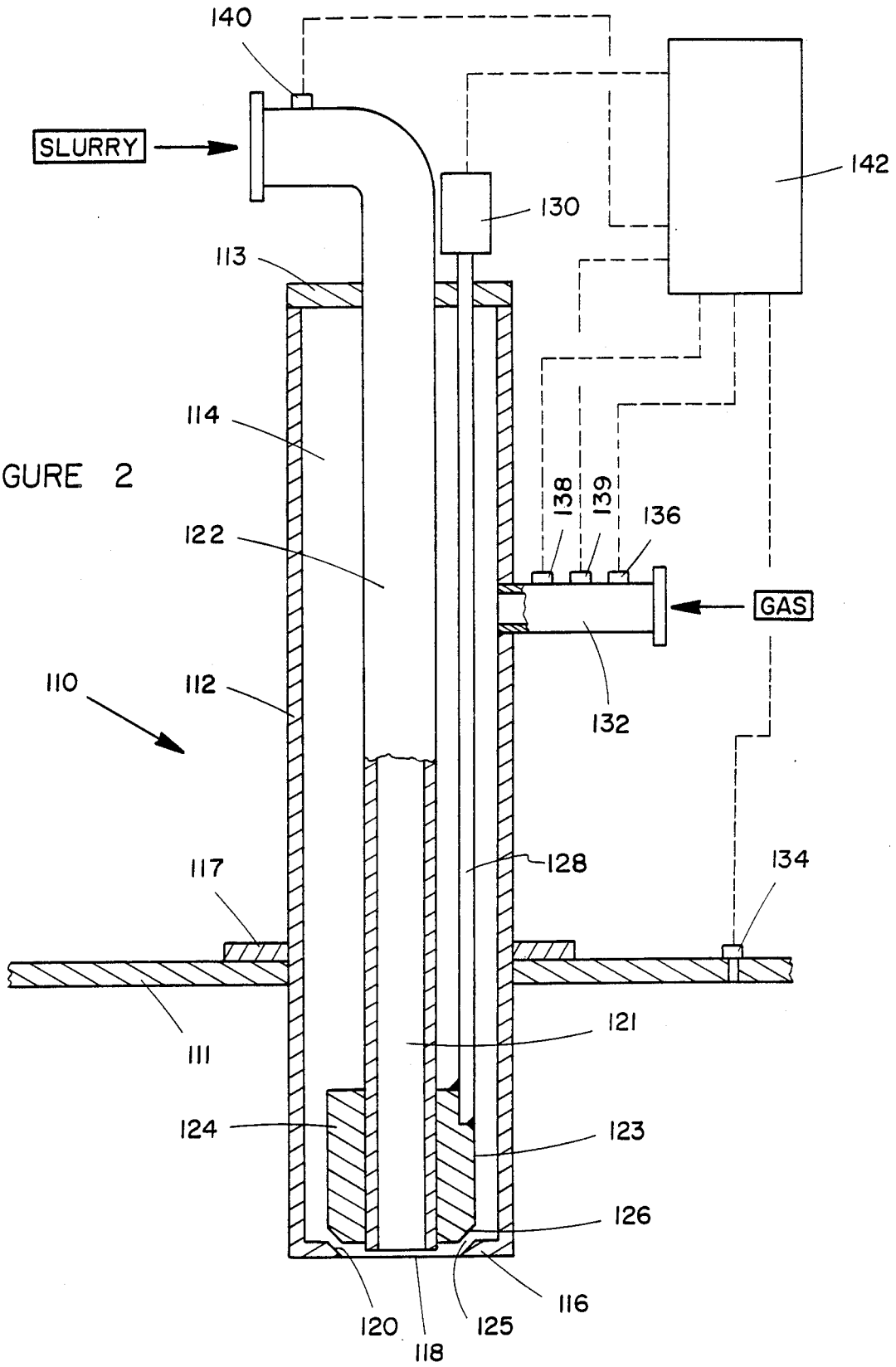

These and other features contributing to satisfaction in use and economy in manufacture will be more fully understood from the following description of preferred embodiments of the invention when taken in connection with the accompanying drawings in which identical numerals refer to identical parts and in which:

FIG. 1 is a vertical partial cross-sectional view showing a first apparatus of this invention; and FIG. 2 is a vertical partial sectional view showing second apparatus of this invention.

Referring now to FIG. 1, there can be seen a process burner of this invention, generally designated by the numeral 10. Process burner 10 is installed with the downstream end passing through vessel wall 12 of a partial oxidation synthesis gas reactor (not shown). Location of process burner 10, be it at the top or at the side of the reactor, is dependent upon reactor configuration. Process burner 10 may be installed either permanently or temporarily depending upon whether or not it is to be used with a permanently installed pre-heat burner or is to be utilized as a replacement for a pre-heat burner, all in the manner as previously described. Mounting of process burner 10 is accomplished by the use of annular flange 11.

Process burner 10 has a hollow cylindrical burner shell 13 which is closed off at its upper end by plate 17 and which defines an interior cylindrical space 21. At the interior lower end of shell 13 is a converging frusto-conical wall 19. At the apex of frusto-conical wall 19 is opening 18 which is in fluid communication with cylindrical conduit 20 as shown in FIG. 1. Cylindrical conduit 20, at its discharge end, terminates into discharge opening 22. For the embodiment shown in the FIG. 1, cylindrical conduit 20 is an integral part of an adjustable two-fluid nozzle.

Passing through and in gas-tight relationship with an aperture in plate 17 is carbonaceous slurry feed line 24. Carbonaceous slurry feed line 24 extends into interior cylindrical space 21 and, at its downstream end, is connected to a port in an annular plate 26 which closes off the upper end of distributor 28. Distributor 28 is comprised of inner tube 14, outer wall 25, frusto-conical wall 32 and outer wall 27. Inner tube 14 is coaxial with all of these walls. The diameter of outer wall 25 is greater than the diameter of outer wall 27. Thus, first annular conduit 30 has a greater cross-sectional are for flow than that for second annular conduit 34. As can be seen in FIG. 1, frusto-conical wall 32 is connected, at its base end, to the downstream end of outer wall 25 and, at its apex end, to the upstream end of outer wall 27. It has been found that by utilizing distributor 28 the flow of carbonaceous slurry from annular opening 23 at the discharge end of distributor 28 will be substantially uniform throughout its annular extent. Selection of the inside diameter of outer wall 25 and the inside diameter of outer wall 27 is made so that the pressure drop that the carbonaceous slurry experiences as it passes through second annular conduit 34, is much greater, say 10 times than the maximum pressure drop in the slurry measured across any annular horizontal cross-sectional plane inside of first annular conduit 30. If this pressur relationship is not maintained, it has been found that uneven annular flow will occur from second annular conduit 34 resulting in the loss of dispersion efficiency when the carbonaceous slurry contacts the frusto-conical oxygen-containing gas stream as hereinafter described.

The difference in the inside diameter of inner tub 14 and the outside diameter of outer wall 25 is at least partially dependent upon the fineness of the carbonaceous material found in the slurry. These diameter differences should be sufficiently large to prevent plugging with the particle size of the carbonaceous material found in the slurry. The difference in these diameters will, in many applications, be within the range of from about 0.1 (0.254 cm) to about 1.0 (2.54 cm) inches.

Tube 14 has coaxially located within its interior axially movable restrictor rod 40 which is another integral part of two-fluid nozzle of process burner 10. The inside surface of tube 14 and the outside surface of restrictor rod 40 provide an annular conduit for the passage of the oxygen-containing gas. This annular conduit is open at both its upstream and downstream ends with the downstream opening being adjacent the upstream end of cylindrical conduit 20. Restrictor rod has sufficient length so that it can additionally extend into cylindrical conduit 20 so that its downstream end can be moved to a point adjacent discharge opening 22.

Restrictor rod 40 can be moved axially by way of actuator 42 which moves the rod through a pressure seal located in plate 17. Other means of giving axial movement to restrictor rod 40 may be used and are well known to those skilled in the art, the only requirement being that the axial movement is made in response to an output signal from microprocessor 44. As can be seen in the drawing, microprocessor 44 is in electrical contact with the actuator.

Several electrical signals are sent to microprocessor 44. The gas mass flow and the liquid mass flow values are communicated to microprocessor 44 by mass flow rate sensing devices 50 and 52, respectively. The gas pressure in the vessel is communicated to microprocessor 44 as well as the pressure of the gas being delivered to process burner 10, the former by way of pressure sensing device 46 and the latter by pressure sensing device 48. The temperature of the gas is measured by device 51. Note that pressure sensing device 48 measures the pressure of the gas delivered to the burner and not the gas pressure of the oxygen-containing gas at the entrance to cylindrical conduit 20. To determine the exact real mixing energy provided by the two-fluid nozzle which comprises cylindrical conduit 20 and restrictor rod 40 the measurement of $P_G$ should be at the cylindrical conduit entrance. However, obtainment of such a measurement would require expensive burner design criteria to so locate a pressure measuring device. Also the device could very well be exposed to high temperatures which could make its design likewise expensive. It has been calculated that the difference between the real mixing energy with $P_G$ measured at the entrance of cylindrical conduit 20 and the mixing energy obtained with $P_G$ measured at the feed point of the oxygen-containing gas is inconsequential for the purposes which process burner 10 will be used. Thus, design cost efficiency dictates the location of device 48 at or near the point of oxygen-containing gas feed. Flow measuring devices 50 and 52 communicate to microprocessor 44 the values, respectively, for the mass of gas flow and the mass of liquid flow. Devices 46, 48, 50, 51, and 52 are of conventional design and can be obtained commercially. Microprocessor 44 can also be of the type which is commercially available. For example, devices 46 and 48 can be a pressure transmitter, such as a Rosemount Model 1151GP. Device 50 can be a flow sensor orifice type primary measuring element with a differential pressure transmitter, such as a Rosemount Model 1151DP. Device 51 can be a thermocouple, exemplified by a Rosemount Model 444. A magnetic flowmeter, such as a Fisher-Porter Model 10D1418, is suitable to serve as device 52. Microprocessor 44 can be a computer, of the same type as Digital Equipment's Model PDP-11. The Rosemount devices are available from Rosemount, Inc., of Minneapolis, Minnesota. The exemplary magnetic flowmeter is available from Fischer-Porter Company of Warminster, Pennsylvania. The Model PDP-11 computer is available from Digital Equipment Corporation, Maynard, Massachusetts. Programming microprocessor 44 in accordance with this invention is achieved by conventional programming techniques.

The oxygen-containing gas is fed to process burner through feed line 36. A portion of the oxygen-containing gas will pass into the open end of tube 14 and through the before-described annular conduit defined by rod 40 and tube 14. The remainder of the oxygen-containing gas flows through the annular conduit defined by the inside wall of burner shell 13 and the outside side walls of distributor 28. The gas passing through cylindrical space 21 will be accelerated as it is forced through the frusto-conical conduit defined by annular frusto-conical surfaces **16, 16*a* and 19. The distance between the annular frusto-conical surfaces 16 and 16*a* and frusto-conical surface 19 is such so as to provide the oxygen-containing gas the velocity required to effectively disperse the carbonaceous slurry being discharged from distributor 28. For example, it has been found that when the oxygen-containing gas passes through tube 14 at a calculated velocity of about 200 ft/sec (60.9 m/sec) and the annular carbonaceous slurry stream passes through discharge end of lower portion 34** at a velocity of about 8 ft/sec (2.44 m/sec) and has an inside, outside diameter difference of about 0.3 inches (0.76 cm), the oxygen-containing gas should pass through the frusto-conical conduit at a calculated velocity of about 200 ft/sec (60.9 m/sec).

Generally speaking, for the flows just and hereinafter discussed, the distance between the two annular frusto-conical surfaces 16 and **16*a* and frusto-conical surface 19 is within the range of from about 0.05 inches (0.127 cm) to about 0.95 inches (2.413 cm). With these flows and relative velocities, it has been also found that the height and diameter of cylindrical conduit 20** should be about 7 inches (17.780 cm) and about 1.4 inches (3.556 cm), respectively.

Frusto-conical surface 19 converges to the longitudinal axis of tube 14 along an angle within the range of from about 15° to about 75°. If the angle is too shallow, say 10°, then the oxygen-containing gas expends much of its energy impacting frusto-conical surface 19. However, if the angle is too deep, then the shear of the carbonaceous slurry achieved is minimized.

Optionally provided for the embodiment of FIG. 1 are fuel gas conduits 54 and 56. These conduits are angled towards the extended longitudinal axis of cylindrical conduit 20. The conduits are also equiangularly and equidistantly radially spaced about this same axis. This angling and spacing is beneficial as it uniformly directs the fuel gas into the carbonaceous slurry/oxygen-containing gas dispersion subsequent to its flow through discharge opening 22. The choice of angularity for the fuel ga conduits should be such that the fuel gas is introduced sufficiently far away from the burner face but not so far as to impede quick mixing and dispersion of the fuel gas into the carbonaceous slurry/oxygen-containing gas dispersion. Generally speaking, the angles $a_1$ and $a_2$ as seen in FIG. 1 should be within the range of from about 30° to about 70°.

In operation, the process burner 10 is brought on line subsequent to the reaction zone completing its preheat phase which brings the zone to a temperature within the range of from about 1500° F. (816° C.) to about 2500° F. (1371° C.). The relative proportions of the feed streams and the optional gaseous temperature moderator that are introduced into the reaction zone through process burner 10, are chosen so that a substantial portion of the carbon in the carbonaceous slurry and the fuel gas is converted to the desirable CO component of the product gas and so that the proper reaction zone temperature is maintained. Maintenance of the proper reaction zone temperature is directly related to the degree of atomization of the carbonaceous slurry. Therefore, the mass flow rates of the gas feeds and the carbonaceous slurry must be taken into account in selecting the relative proportions thereof.

The dwell time in the reactor for the atomized carbonaceous slurry-oxygen containing gas dispersion will be about 1 to about 10 seconds.

Depending upon the carbonaceous material used, the identity of the oxygen-containing gas and the process conditions necessary to yield the desired product, selection of the various feed and process parameters is made. Exemplary ranges are given by the following. The oxygen-containing gas is fed to process burner 10 at a temperature dependent upon its $O_2$ content. For air, the temperature will be from about ambient to about 1200° F. (649° C.), while for pure $O_2$, the temperature will be in the range of from about ambient to about 800° F. (427° C.). The oxygen-containing gas will be fed under a pressure of from about 2 to about 250 atmospheres. The carbonaceous slurry will be fed at a temperature of from about ambient to about the saturation temperature of the liquid carrier and at a pressure of from about 2 to about 250 atmospheres. The fuel gas, which is utilized to raise the reaction zone temperature after pre-heating to the reaction temperature and to maintain the reaction zone within the desired temperature range, is preferably methane and is fed at a temperature of from about ambient to about 1200° F. (649° C.) and under a pressure of from about 2 to about 250 atmospheres. Quantitatively, the carbonaceous slurry, fuel gas and oxygen-containing gas will be fed in amounts to provide weight ratio of free oxygen to carbon which is within the range of from about 0.9 to about 2.27.

The carbonaceous slurry is fed via tube 1 to the interior of distributor 28 at a preferred flow rate of from about 0.1 to about 5 ft/sec (0.0305 to 1.524 m/sec). Due to the smaller diameter of lower portion 34, the velocity of the carbonaceous slurry will increase to be within the range of from about 1 to about 50 ft/sec (about 0.305 m/sec to about 15.24 m/sec).

When burner nozzle 10 is initially placed into operation the rate of fuel gas feed through fuel conduits 54 and 56 will be predominant over the rate of carbonaceous slurry feed. As the carbonaceous slurry feed is increased, however, the rate of fuel gas feed is decreased. This contemporaneous slow conversion from fuel gas feed to carbonaceous slurry feed will continue until fuel gas feed is completely stopped.

After selection of the vessel pressure, the gas mass flow rate and the slurry mass flow rate, the gas feed pressure is adjusted to yield the desired degree of atomization. Generally speaking atomization which results in the carbonaceous slurry having a volume median droplet size in the range of from about 100 to about 600 microns is preferable for most coal gasification processes. The mixing energy value is determined after the selected atomization is achieved and will serve as a set point from which the microprocessor can operate. Once the set point mixing energy is determined, continual monitoring and measuring with devices 46, 48, 50 and 52 is effected. The measurements are fed to microprocessor 44 which compares the present mixing energy with the set point mixing energy. If there is a difference between the two mixing energy values, microprocessor 44 outputs to actuator 42 causing it to adjust the position of restriction rod 40 within cylindrical conduit 20 to give the necessary gas pressure value to return the mixing energy to within an acceptable range.

Optionally, should there be process upset of such magnitude that the mixing energy adjustment needed is outside of the range of adjustability for restrictor rod 40, then the slurry and gas nozzle feeds can be turned down or off and fuel gas can be fed through conduits 54 and 56 to provide maintenance of reactor temperature until proper process conditions can be reestablished.

Referring now to FIG. 2, there can be seen another apparatus of this invention, generally designated by the numeral 110. Apparatus 110 is attached to vessel wall 111 by way of flange 117. Apparatus 110 has a cylindrical tube 112 which is closed off at its distal end by plate 113 and which defines a cylindrical space. At its proximate end, cylindrical tube 112 has bottom wall 116 which has a discharge opening 11 which is defined by frusto-oonical wall 120. Coaxial with the longitudinal axis of cylindrical tube 112 and located within cylindrical space 114 is tube 122 which provides a central cylindrical conduit 121. Tube 122, at its distal end, is in communication with a liquid source. The proximate end of tube 122 is located adjacent discharge opening 118.

Slidably mounted to tube 122 is restrictor 124. Restrictor 124 moves axially towards and away from frusto-conical wall 120. Operating rod 128 is in association with actuator 130 to effect the axial movement of restrictor 124. At the proximate end of restrictor 124 there is provided frusto-conical surface 126. Frusto-conical surfaces 126 and 120 define therebetween a frusto-conical conduit 125 which has a cross-sectional area for flow smaller than the cross-sectional area of flow provided by the annular space defined by the inside wall of cylindrical wall 112 and the outside wall 123 of restrictor 124. The cross-sectional area for flow of frusto-conical conduit 125 is adjustable by the axial movement of restrictor 124. Movement of restrictor 124 to a point further from frusto-conical surface 120 increases the cross-sectional area for flow while movement to a point closer to frusto-conical surface 120 decreases the cross-sectional area for flow. As the cross-sectional area for flow is decreased, pressure drop realized by a gas passing through frusto-conical conduit 125 is increased while an increase in the cross-sectional area for flow results in a decrease in pressure drop.

Gas is fed through feed line 132 to the interior of cylindrical wall 112. The liquid fed to apparatus 110 enters tube 122 at its distal end at a point upstream of plate 113.

To measure and monitor the pressure within the vessel to which apparatus 110 is associated, there is provided pressure sensing device 134. Device 134 provides an output to microprocessor 142. The gas feed pressure and mass flow are measured, respectively, by pressure sensing device 136 and mass flow rate sensing device 138. These two devices have outputs which are communicated to microprocessor 142. The mass flow rate of the liquid passing within the conduit defined by tube 122 is measured and monitored by liquid mass flow rate sensing device 140. Device 140 also provides an output to microprocessor 142. Device 139 measures gas temperature.

Devices 134, 136, 138, 139 and 140 and microprocessor 142 can be any of those suitable types which are commercially available. The devices and microprocessor exemplified in the description of the embodiment of FIG. 1 are also be suitable for apparatus 110. The only requirement for suitability is that the devices be capable of measuring the pressures and flow rates anticipated and that they be constructed so as to not be deleteriously affected by the materials handled. Microprocessor 142 is programmed to calculate the mixing energy provided by the two fluid nozzle position, i.e. frusto-conical conduit 125 and central cylindrical conduit 121, of apparatus 110 in accordance with either of the previously described derived equations for mixing energy and with the inputs from devices 134, 136, 138, 139 and 140. The location of device 136 is not at a point adjacent and upstream of frusto-conical conduit 125, however, its location at feed line 132 does not introduce error too substantial for effective working of apparatus 110 in maintaining constant mixing energy. Microprocessor 142 has an output to signal the activation of actuator 130 to give the desired axial movement to restrictor 124.

In operation, liquid is fed to conduit 121 and gas is fed through feed line 132 into cylindrical space 114. The position of restrictor 124, the vessel gas pressure, feed gas pressure, gas mass flow and liquid mass flow are all set so that the desired degree of atomization is provided by nozzle 121. Microprocessor 142 calculates the initially set mixing energy.

During the continued operation of apparatus 110, there is continuous monitoring by devices 134, 136, 138 and 140. Their outputs are used by microprocessor 142 to determine present time mixing energy against the initially set mixing energy. Should there be a substantial variance, microprocessor 142 will provide an output to actuator 130 to move restrictor 124 to change $P_G$ until the present time mixing energy is within an acceptable range of the initial mixing energy.

I claim:

1. The combination of a vessel and an apparatus for the discharge of an atomized liquid and gas dispersion into said vessel, said apparatus comprising:
   (a) a first conduit in liquid communication with a liquid source and a second conduit in gas communication with a gas source;
   (b) an adjustable two-fluid nozzle which provides a substantially constant mixing energy for effecting the atomization of said liquid and which is in liquid and gas communication, respectfully, with said first and second conduits;
   (c) first pressure sensing means for measuring the gas pressure in said vessel and for providing an output indicative of the measurement;
   (d) second pressure sensing means for measuring the gas pressure of the gas entering said two-fluid nozzle and for providing an output indicative of the measurement;
   (e) first flow rate sensing means for measuring the mass of liquid communicated to said two-fluid nozzle and for providing an output indicative of the measurement; and
   (f) second flow rate sensing means for measuring the mass of gas communicated to said two-fluid nozzle and for providing an output indicative of the measurement.

2. The combination of claim 1 wherein said first conduit is coaxial with and disposed within second conduit.

3. The combination of claim 1 wherein said two-fluid nozzle comprises a cylindrical conduit having a cross-sectional area for flow less than the total cross-sectional area for flow of said first and second conduit.

4. The combination of claim 3 wherein said two-fluid nozzle additional includes a restrictor rod which is coaxially movable within said cylindrical conduit so as to change the pressure drop across said cylindrical conduit.

5. The combination of claim 4 wherein said apparatus additionally includes a calculating and comparing means which,
   (i) is connected to and receives the outputs of said first pressure sensing means, said second pressure sensing means, said first flow rate sensing means and said second flow rate sensing means,
   (ii) calculates the mixing energy delivered by said two-fluid nozzle near the time of receipt of said outputs,
   (iii) compares the calculated mixing energy-value against a pre-selected mixing energy value, and
   (iv) provides an output to effect the adjustment of said two-fluid nozzle, if needed, so that said two-fluid nozzle provides a mixing energy substantially equal to the pre-selected mixing energy.

6. The combination of claim 5 wherein said apparatus additionally includes a powered actuator connected to said restricted rod to effect said coaxial movement of said restrictor rod and wherein said calculating and comaparing means is a microprocessor which is connected to said powered actuator and which provides an output, when needed, to said powered actuator to cause said powered actuator to move said restrictor rod so that said two-fluid nozzle delivers a mixing energy substantially equal to said preselected mixing energy.

7. The combination of claim 6 wherein said calculating and comparing means is a microprocessor which is programmed to calculate the mixing energy in accordance with the formula $$E_M = \frac{CM_g}{M_L}\left(\frac{K}{K-1}\right)\left[\left(\frac{P_g}{P_v}\right)^{\frac{K-1}{K}} - 1\right]\frac{RT}{Ag}$$

wherein, $C = 0.07250$,
$M_g$ = mass flow of gas, as lbs/hr,
$M_L$ = mass flow of liquid, as lbs/hr,
$R$ = gas law constant and is 10.73,
$T$ = dowbstrean gas temperature, as $^oR$
$A_g$ = atomic weight of the gas,
$P_g$ = conduit gas pressure, as psia,
$P_V$ = vessel gas pressure, as psia, and
$K$ = the heat capacity ratio of the gas components.

8. The combination of claim 1 wherein said two-fluid nozzle comprises a central conduit in liquid communication with said first conduit and a stationary frusto-conical surface having its base facing the apex of a coaxially movable second frusto-conical surface, said stationary and movable frusto-conical surfaces defining a frusto-conical conduit having a cross-sectional area for flow less than the cross-sectional area for flow of said second conduit and being coaxially located at the discharge end of said central conduit.

9. The apparatus of claim 8 wherein said first conduit is coaxial with and disposed within said second conduit.

10. The combination of claim 8 wherein said apparatus additionally includes a calculating and comparing means which, (i) is connected to and receives the outputs from said first pressure sensing means, said seond pressure sensing means, said first flow rate sensing means and said second flow rate sensing means, (ii) calculates the mixing energy delivered by said two-fluid nozzle near the time of receipt of said outputs, (iii) compares the calculated mixing energy-value against a pre-selected fixing energy value, and (iv) provides an output to effect the adjustment of said two-fluid nozzle, if needed, so that said two-fluid nozzle provides a mixing energy substantially equal to the pre-selected mixing energy.

11. The combination of claim 10 wherein said apparatus additionally includes a powered actuator connected to said to effect said movable second frusto-concial surface coaxial movement of said movable second frusto-conical surface and wherein said calculating and comparing means is a microprocessor which is connected to said powered actuator and which provides an output, when needed, to said powered actuator to cause said powered actuator to move said movable second frusto-conical surface so that said two-fluid nozzle delivers a mixing energy substantially equal to said preselected mixing energy.

12. The combination of claim 11 wherein said calculating and comparing means is a microprocessor which is programmed to calculate the mixing energy in accordance with the formula $$E_M = \frac{CM_g}{M_L}\left(\frac{K}{K-1}\right)\left[\left(\frac{P_g}{P_v}\right)^{\frac{K-1}{K}} - 1\right]\frac{RT}{Ag}$$

wherein,

C=0.07250, $M_g$=mass flow of gas, as lbs/hr, $M_L$=mass flow of liquid, as lbs/hr, R=gas law constant and is 10.73, T=downstream gas temperature, as °R $A_g$=atomic weight of the gas, $P_g$=conduit gas pressure, as psia, $P_V$=vessel gas pressure, as psia, and K=the heat capacity ratio of the gas components.

13. The combination of claim 1 wherein said apparatus additionally includes a calculating and comparing means which;

(i) is connected to and receives the outputs from said frist pressure sensing means, said second pressure sensing means, said first flow rate sensing means and said second flow rate sensing means, (ii) calculates the mixing energy delivered by said two-fluid nozzle near the time of receipt of said outputs, (iii) compares the calculated mixing energy-value against a pre-selected mixing energy value, and (iv) proides an output to effect the adjustment of said two-fluid nozzle, if needed, so that said two-fluid nozzle provides a mixing energy substantially equal to the pre-selected mixing energy.

14. The combination of claim 13 wherein said calculating and comparing means is a microprocessor which is programmed to calculate the mixing energy in accordance with the formula $$E_M = \frac{CM_g}{M_L}\left(\frac{K}{K-1}\right)\left[\left(\frac{P_g}{P_v}\right)^{\frac{K-1}{K}} - 1\right]\frac{RT}{Ag}$$

wherein,

C=0.07250, $M_g$=mass flow of gas, as lbs/hr, $M_L$=mass flow of liquid, as lbs/hr, R=gas law constnt and is 10.73, T=downstream gas temperature, as °R $A_g$=atomic weight of the gas, $P_g$=conduit gas pressure, as psia, $P_V$=vessel gas pressure, as psia, and K=the heat capacity ratio of the gas components.

* * * * *